United States Patent [19]

Davis

[11] 4,339,876

[45] Jul. 20, 1982

[54] SHAVING SYSTEM AND METHOD

[76] Inventor: Alton A. Davis, 15900 NW. 45th Ave., Opa-Locka, Fla. 33054

[21] Appl. No.: 203,350

[22] Filed: Nov. 3, 1980

[51] Int. Cl.[3] ..... B26B 21/40

[52] U.S. Cl. ..... 30/90; 206/228

[58] Field of Search ..... 30/40, 40.2, 90; 206/228

[56] References Cited

U.S. PATENT DOCUMENTS

| | | | |
|---|---|---|---|
| 3,206,012 | 9/1965 | Braginetz | 206/228 |
| 3,754,326 | 8/1973 | Glaberson | 30/90 X |
| 3,760,938 | 9/1973 | Ferrier, Jr. | 30/90 X |
| 3,915,300 | 10/1975 | Gatley | 30/90 X |

*Primary Examiner*—James G. Smith

*Attorney, Agent, or Firm*—Cesari and McKenna

[57] ABSTRACT

A shaving system in the nature of a kit comprises a single elongated handle and a pair of disposable blade assemblies, one blade assembly carrying a single edge blade and the other blade assembly carrying a pair of closely spaced twin blades. The handle end and each blade assembly are formed with coacting twist-lock fittings so that first the single edge blade assembly and then the double edge blade assembly can be detachably connected to the handle so that the user can shave with both blade assemblies in sequence to obtain an unusually close shave. The kit also includes a covered caddy for receiving and retaining the handle and two blade assemblies when they are not in use.

6 Claims, 5 Drawing Figures

SHAVING SYSTEM AND METHOD

This invention relates to a unique shaving system. It relates more particularly to a shaving apparatus and method which enables the user to obtain an unusually close facial shave without experiencing a razor burn.

BACKGROUND OF THE INVENTION

Conventional safety razors seldom meet or exceed the standard of performance of the old fashioned straight edge razor wielded by an expert barber. The reasons for this are two-fold. First, the average person usually does not properly prepare his face prior to shaving. The average shaver starts and finishes his shave with the same blade edge. It is virtually impossible to achieve a close shave without experiencing razor burn with the same razor edge.

First, one should wash or moisten the face and apply lightly a shaving base such as Noxema cream followed by regular shaving lather. The face is now ready for shaving by a single edge hollow ground razor which removes the heavy beard. Then the face should be rinsed clean of all shaving materials. With the face left moistened, one should finish the shave with a second razor namely a twin type feather edge razor. The net result of this procedure is an extremely smooth shave without razor burn that will last all day and throughout the evening.

Accordingly, it would be desirable to incorporate the characteristics and advantages of a straight edge razor into a compact safety razor which could be used in the home by the average person who does not have the skills of a barber.

SUMMARY OF THE INVENTION

Accordingly, the present invention aims to provide a shaving system by which one can obtain a closer shave than is obtainable from prior conventional razors.

Another object is to provide a shaving method which produces an unusually close shave without causing razor burn.

A further object of the invention is to provide a shaving appliance which enables one to shave sequentially with a hollow ground single edge blade and twin feather edge blades.

Yet another object of the invention is to provide a razor such as this whose blade assemblies are disposable.

Still another object is to provide a shaving kit composed of a razor handle, detachable blade assemblies having different shaving characteristics for attachment to the handle and a convenient caddy for organizing and storing the handle and blade assemblies when they are not in use.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my shaving kit comprises a caddy or container having specially profiled receptacles therein for receiving and retaining a rod-like razor handle and a pair of blade assemblies for sequential attachment to the handle. One blade assembly is fitted with a single, hollow ground blade; the other blade assembly is formed with closely spaced parallel twin blades with feathered or wedge-shaped edges. The caddy thus supports the razor handle and blade assemblies for display purposes at the point of sale. In addition, the caddy organizes the components of the razor on a shelf or in a medicine chest in the home when they are not in use. Preferably also, the caddy is provided with a transparent cover which protectively encloses the razor components reposing in the caddy.

As will be described later, the razor assemblies and the handle are provided with convenient twist-lock connectors so that, when the razor is being used, the assemblies can be attached and detached from the handle quite easily by the shaver.

To use the kit, the single edge blade assembly is first attached to the handle. Then, the shaver prepares his face by wetting it and preferably also applying a layer of skin cream. Next, the shaver applies lather to the face and shaves using the single edge blade assembly. Following this, he replaces the single edge blade assembly on the handle with the twin edge assembly and rinses his face free of all shaving materials prior to shaving with the twin edge blade assembly. Finally, following the second shave, he rinses and dries his face, thereby completing the shaving process.

By shaving twice with two different blade assemblies having two different shaving characteristics, the user is able to remove the preponderance of his beard with the first shave, permitting the twin edge blade assembly to achieve very intimate contact with his skin during the second shaving pass. Resultantly, the person receives a very close clean shave which lasts substantially an entire day obviating the need of the person to shave again in the event that he has an evening appointment.

As will be seen presently, the components of the shaving kit are relatively simple to make and easy to clean. Therefore, they should have a long useful life. The single and twin edge blade assemblies are designed to be disposable. When they eventually become dulled through use, new ones are purchased to replace them in the shaving kit so that they will be ready for use when the next shave is required.

BRIEF DESCRIPTION OF THE DRAWING

For a fuller understanding of the nature and objects of the invention, reference should be had to the following detailed description, taken in connection with the accompanying drawing, in which.

DESCRIPTION OF THE PREFERRED EMBODIMENT

Figure 4:
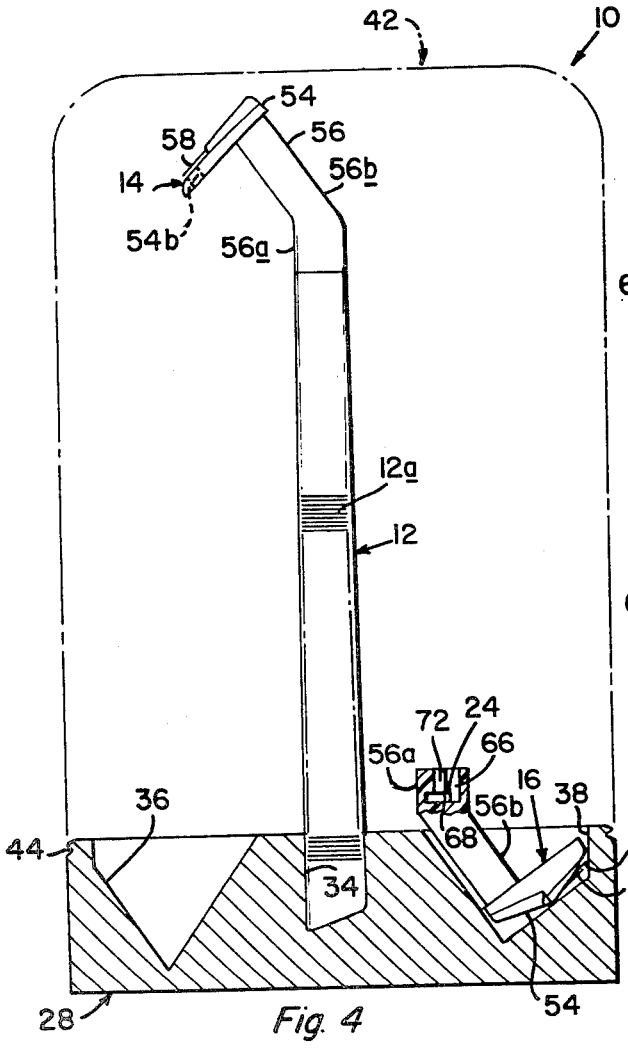
FIG. 4 is a side elevational view with parts in section showing the shaving kit components in assembled form.

Referring first to FIG. 4 of the drawing, my shaving kit shown generally at 10 comprises a razor handle 12 having a roughened surface 12*a* and to which is connected sequentially a single edge blade assembly shown generally at 14 and a twin edge blade assembly shown generally at 16. In order to detachably connect one assembly or the other to the handle, the handle is fitted with a male twist-lock fitting 18 (FIG. 2) which interfits with a female fitting 22 formed at the end of assembly 14 and a similar fitting 24 present at the end of assembly 16.

The handle 12 and the two blade assemblies 14 and 16 are organized in a caddy indicated generally at 28. Preferably the caddy is an inexpensive molded plastic article. It is formed with a vertical recess 34 for receiving and retaining the end of the handle 12 remote from its fitting 18 so that the handle projects upwardly as illustrated in FIG. 4. A relatively large wedge-shaped receptacle 36 is formed at one side of recess 34 for receiving and retaining the inverted blade assembly 14. A similar receptacle 38 is formed at the opposite side of recess 34 for retaining blade assembly 16.

When the three components of the razor are retained at their respective positions in the caddy, a cover 42 (shown in dotted lines), preferably made of a transparent plastic such as polystyrene, can be engaged over those components and seated on a peripheral lip 44 formed in the upper surface of the caddy 28. Thus, when the razor is not in use, its three components are organized and always available. Furthermore, those components and particularly the assembly blade edges are protected from dust and moisture.

Figure 3A:
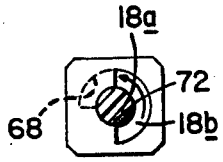
FIGS. 3A and 3B are sectional views along line 3—3 of FIG. 2 showing the handle and a blade assembly in its unlocked and locked positions respectively.
Figure 3B:
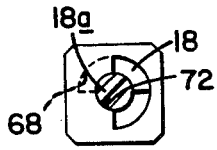
Figure 2:
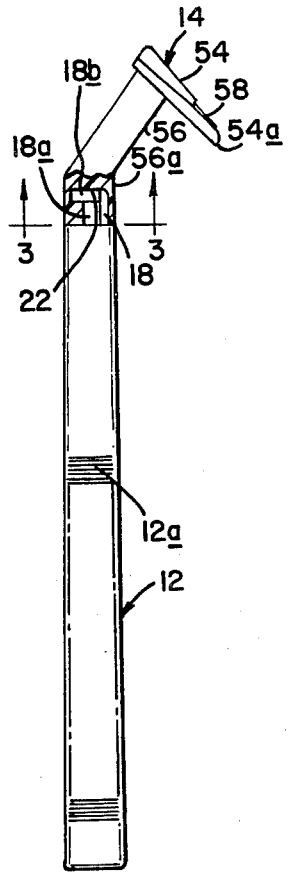
FIG. 2 is a side elevational view with parts broken away of the handle and single edge blade assembly components of the kit.

Referring now to FIGS. 2, 3A and 3B, the handle fitting 18 comprises a relatively small diameter cylindrical neck **18*a* which is topped by a semicylindrical head or lug 18*b*. As best seen in FIG. 3A, the lug 18*b* is coaxial with neck 18*a***.

The blade assemblies 14 and 16 are substantially identical except for their blades. Therefore, in describing the assemblies, the same identifying numerals are used for corresponding elements on those assemblies. Each assembly comprises a head 54 having a neck 56 projecting more or less perpendicular to the head. However, the end segment **56*a* of the neck containing the fitting 22 or 24 is bent or formed at an obtuse angle with respect to the remaining neck segment 56*b* so that, when the blade assembly is attached to the handle as shown in FIG. 2 and the handle is held in the normal way by the user, the head 54** is oriented at the correct shaving angle relative to the skin surface, e.g. 20°.

Figure 1:
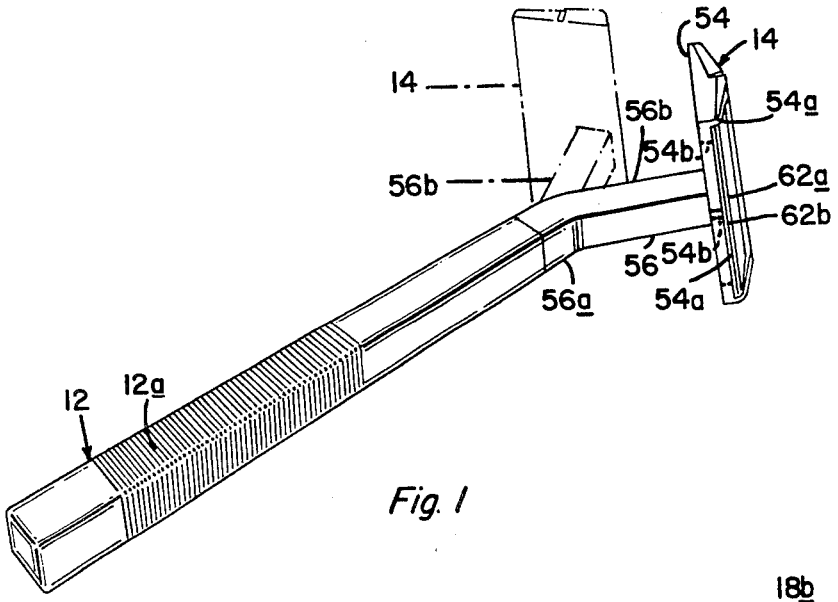
FIG. 1 is a perspective view showing in solid lines the razor handle and twin edge blade assembly components of my shaving system and kit.

Since each shaving assembly is intended to be disposable, and hence must be inexpensive, the head 54 and its neck 56 are formed as an integral molded plastic part. The head 54 may assume a variety of configurations so long as it is constructed to retain a razor blade at the proper angle. Thus the head 54 of assembly 14 retains a single edge hollow ground blade 58. On the other hand, as shown in FIGS. 1 and 4, the head 54 of assembly 16 supports a pair of blades **62*a* and 62*b* in a closely spaced parallel relationship similar to the twin blade assembly sold under the brand name Gillette Trac II. Preferably also, the edge of each head 54 underlying the blade is beveled as shown at 54*a* so that it rides smoothly over the surface being shaved. In addition, the head is formed with the usual drain openings 54*b* as shown in FIG. 1**, to facilitate flushing and rinsing the blade edge after use.

As best seen in FIGS. 2 and 4, the female connector fittings 22 and 24 each comprises a semicylindrical passage 66 which extends down into the associated neck segment **56*a*, the depth of passage 66 being substantially the same as the combined lengths of the fitting neck 18*a* and lug 18*b* on handle 12. On the other hand, the diameter of the passage is substantially the same as the diameter of lug 18*b***.

As shown in FIGS. 3A, 3B and 4, formed at the bottom of passage 66 contiguous therewith is a quadrant passage 68 whose radius is the same as that of passage 66 and whose depth is slightly greater than the height of the handle lug **18*b*. Thus the handle lug 18*b* can be inserted into passage 66 as shown in FIG. 3A so that it bottoms in that passage and then twisted approximately 90° in the direction of the arrow to the position shown in FIG. 3B so that one end of the lug engages in the quadrant passage 68** thereby locking the blade assembly to the handle.

A small semicircular passage 72 is formed in neck segment **56*a* which is coaxial with passages 66 and 68 to accommodate the handle fitting neck 18*a* when the handle is inserted and turned as aforesaid. The clearances between the opposing surfaces of the connector fitting 18*a* on the one hand and fittings 22 and 24 on the other are sufficiently close that when the handle is oriented relative to the blade assembly as shown in FIG. 3B**, the assembly is securely attached to the handle. Resultantly, when the razor is manipulated during shaving, those two parts do not separate.

When it is desired to remove the blade assembly from the handle, the handle is turned approximately 90° relative to the handle in the direction opposite the arrow in FIG. 3A which permits the lug **18*b* to be withdrawn from passage 66**.

In order to achieve an unusually close shave which is the prime object of the present invention, both of the blade assemblies 14 and 16 comprising kit 10 must be employed one after the other. To use the kit, the handle 12 is removed from caddy 28 and attached to the single edge blade assembly 14 as described above. Then the user moistens his face and preferably also applies a layer of skin cream such as Noxema cream. Then he lathers the face in the usual way and shaves, using the single edge blade assembly 14. Preferably, that blade is hollow ground and suffices to remove most of the user's beard. Then the user replaces assembly 14 with the double edge blade assembly 16 on handle 12 and, after rinsing his face to remove all shaving materials, he shaves using that blade assembly so that the twin blades **62*a* and 62*b*** remove the remaining beard ends at or even slightly below the skin surface. Following the second shave, the user washes and dries his face, completing the shaving process.

It has been found that, following the aforesaid technique, even a person with a very heavy beard will appear cleanly shaved for substantially an entire 24-hour day. This means that after shaving in the morning, he does not have to shave again even if he goes out in the evening. Moreover, using my kit, the incidence of facial irritation due to too frequent shaving is materially reduced.

After using the blade assembly 14 or 16 for a number of shaves, which number depends upon the nature of the user's beard, the assembly is simply thrown away and replaced with a new one, the razor handle 12, caddy 28 and cover 42 being retained and reused again and again.

It will thus be seen that the objects set forth above, among those made apparent from the preceding description, are efficiently attained. Also, certain changes may be made in the above construction without departing from the scope of the invention. For example, the blade assemblies 14 and 16 can be formed as a unitary part. In other words, the necks of the two blade assemblies can be provided with a common neck segment **56*a*** with the two segments 56*b* projecting out in opposite directions as shown in dotted lines in FIG. 1. Thus, when segment 56*a* is locked to the handle 12, the user shaves with one assembly or the other simply by appropriately rotating the handle 180° about its axis relative to his face. Therefore, it is intended that all matter contained in the above description or shown in the accompanying drawing be interpreted as illustrative and not in a limiting sense.

It is also to be understood that the following claims are intended to cover all of the generic and specific features of the invention herein described.

What is claimed as new and desired to be secured by Letters Patent of the United States is:

1. A shaving kit comprising an elongated handle, a pair of blade assemblies to be used in sequence, each assembly having an elongated neck and a head formed integrally with the neck, a single edge blade mounted in one shaving assembly head, a pair of closely spaced, parallel blades mounted in the other shaving assembly head, coacting means on an end of the handle and on the free end of the neck of each blade assembly for detachably connecting the neck to the handle, and a caddy for removably retaining the handle and the two blade assemblies, said caddy comprising a container having three receptacles, one receptacle sized to receive and retain an end of the handle and the other two receptacles sized to receive and retain the two blade assemblies.

2. The kit defined in claim 1 and further including a protective cover for engaging over the handle and blade assemblies retained in the caddy and seating on the caddy.

3. The kit defined in claim 1 wherein the connecting means comprise a twist-lock connector, one component of the connector being mounted to the end of the handle and the other component of the connector being formed at the free end of each blade assembly neck.

4. The kit defined in claim 3 wherein the connector component on the handle comprises a cylindrical neck projecting from the end of the handle and a larger diameter semicylindrical lug formed on the free end of the neck with the centers of the neck and the lug coinciding, and the connector component on each shaving assembly neck comprises a semicylindrical passage extending into the free end of the neck, the diameter of the passage being more or less the same as that of the lug, a quadrant passage formed at the bottom of the semicylindrical passage, said quadrant passage being coaxial with and having the same radius as that of the semicylindrical passage so that the lug can be inserted into the longitudinal passage and turned at right angles about its axis so that an end of the lug extends into the quadrant passage thereby locking the blade assembly neck to the handle.

5. The kit defined in claim 4 wherein each blade assembly neck extends at right angles relative to the associated blade assembly head, with the segment of each neck containing the passages being oriented at an obtuse angle relative to the remainder of the neck so that, when the handle is grasped by the user while shaving, the blade mounted to the head of each blade assembly is oriented at the proper shaving angle relative to the surface being shaved.

6. A shaving method comprising the steps of washing the face; applying a thin layer of facial cream to the face; applying lather to the face over the cream layer; shaving the face with a single edge hollow ground razor; rinsing the face free of all shaving materials and shaving again with a twin type feather edge razor.

* * * * *